US011280530B2

(12) United States Patent
Tada et al.

(10) Patent No.: US 11,280,530 B2
(45) Date of Patent: Mar. 22, 2022

(54) AIR CONDITIONER PROVIDED WITH MEANS FOR PREDICTING AND DETECTING FAILURE IN COMPRESSOR AND METHOD FOR PREDICTING AND DETECTING THE FAILURE

(71) Applicant: Hitachi-Johnson Controls Air Conditioning, Inc., Tokyo (JP)

(72) Inventors: Shuuhei Tada, Tokyo (JP); Katsuaki Nagahashi, Tokyo (JP); Koji Naito, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 900 days.

(21) Appl. No.: 15/757,779

(22) PCT Filed: Sep. 11, 2015

(86) PCT No.: PCT/JP2015/075815

§ 371 (c)(1),
(2) Date: Mar. 6, 2018

(87) PCT Pub. No.: WO2017/042949

PCT Pub. Date: Mar. 16, 2017

(65) Prior Publication Data

US 2018/0347879 A1 Dec. 6, 2018

(51) Int. Cl.
*F25B 49/02* (2006.01)
*F04B 49/10* (2006.01)
(Continued)

(52) U.S. Cl.
CPC ..... *F25B 49/02* (2013.01); *F04B 35/04* (2013.01); *F04B 49/065* (2013.01); *F04B 49/10* (2013.01);
(Continued)

(58) Field of Classification Search
CPC ..... F25B 49/02; F25B 49/005; F25B 13/00; F25B 2313/02741; F25B 13/005;
(Continued)

(56) References Cited

U.S. PATENT DOCUMENTS 4,939,909 A * 7/1990 Tsuchiyama ..... F25B 49/022 62/158
2007/0013330 A1* 1/2007 Noh ..... H02P 6/15 318/400.03
(Continued)

FOREIGN PATENT DOCUMENTS

EP 2007006 A2 * 12/2008 ..... H02P 27/06
JP 61-169684 A 7/1986
(Continued)

OTHER PUBLICATIONS

International Search Report of PCT/JP2015/075815 dated Dec. 22, 2015.

*Primary Examiner* — Michael J Dalbo
(74) *Attorney, Agent, or Firm* — Mattingly & Malur, PC

(57) ABSTRACT

To predict and detect a failure in a compressor provided in an air conditioner, the air conditioner is provided with: a heat exchanger; the compressor; piping connecting the heat exchanger and the compressor with each other; and a control unit controlling the compressor and having a compressor failure predicting and detecting means, and in this air conditioner, the compressor failure predicting and detecting means of the control unit includes: a current detecting part detecting a driving current driving the compressor; a pulsation detecting part detecting pulsation in a driving current detected by the current detecting part; and an anomaly determining part predicting or detecting any failure in the compressor based on a magnitude and a duration of pulsation in a driving current detected by the pulsation detecting part.

6 Claims, 8 Drawing Sheets

(51) Int. Cl.

| | |
|---|---|
| ***F04B 35/04*** | (2006.01) |
| ***F25B 49/00*** | (2006.01) |
| ***F25B 13/00*** | (2006.01) |
| ***F04B 49/06*** | (2006.01) |
| ***F04C 23/00*** | (2006.01) |
| ***F04C 28/28*** | (2006.01) |
| ***F04C 18/02*** | (2006.01) |

(52) U.S. Cl.
CPC ..... *F04C 23/008* (2013.01); *F04C 28/28* (2013.01); *F25B 13/00* (2013.01); *F25B 49/005* (2013.01); *F04B 2203/0201* (2013.01); *F04B 2203/0212* (2013.01); *F04B 2203/0213* (2013.01); *F04B 2207/70* (2013.01); *F04C 18/0215* (2013.01); *F04C 2270/052* (2013.01); *F04C 2270/07* (2013.01); *F04C 2270/60* (2013.01); *F04C 2270/80* (2013.01); *F25B 2313/005* (2013.01); *F25B 2313/02741* (2013.01); *F25B 2700/151* (2013.01)

(58) Field of Classification Search
CPC .. F25B 2700/151; F04B 35/04; F04B 49/065; F04B 49/10; F04B 2207/70; F04B 2203/0212; F04B 2203/0201; F04B 2203/0213; F04C 2270/052; F04C 2270/80; F04C 23/008; F04C 28/28; F04C 2270/07; F04C 18/0215; F04C 2270/60
See application file for complete search history.

(56) References Cited

U.S. PATENT DOCUMENTS

| | | | | |
|---|---|---|---|---|
| 2010/0293397 | A1* | 11/2010 | Pham | F04B 51/00 713/300 |
| 2012/0038301 | A1* | 2/2012 | Iwasaki | H02K 37/14 318/400.23 |
| 2013/0325240 | A1* | 12/2013 | Ozaki | F16C 19/187 701/22 |
| 2018/0219508 | A1* | 8/2018 | Arisawa | H02M 7/5395 |

FOREIGN PATENT DOCUMENTS

| | | | |
|---|---|---|---|
| JP | 2623526 | B | 4/1997 |
| JP | 2008-38912 | A | 2/2008 |
| JP | 4232162 | B | 12/2008 |

* cited by examiner

AIR CONDITIONER PROVIDED WITH MEANS FOR PREDICTING AND DETECTING FAILURE IN COMPRESSOR AND METHOD FOR PREDICTING AND DETECTING THE FAILURE

TECHNICAL FIELD

The present invention relates to a means for predicting and detecting a failure in a compressor provided in a refrigerating device or an air conditioner and a method for predicting and detecting the failure.

BACKGROUND ART

A background art of the present invention is described in Patent Literature 1. In the technology disclosed in Patent Literature 1, an instantaneous current or instantaneous voltage applied to a compressor is detected. Any failure in the compressor is predicted and diagnosed by estimating an internal state of the compressor, especially, a motor driving torque from this detection value and further estimating poor lubrication, liquid compression, and the like.

CITATION LIST

Patent Literature

PTL 1: Japanese Patent Application Laid-Open No. 2008-38912

SUMMARY OF INVENTION

Technical Problem

In a refrigerating device, for example, an air conditioner in which a refrigerating cycle is composed of a compressor, a condenser, an expansion mechanism, and a vaporizer, inoperativeness resulting from any failure in the compressor will significantly impair a user's comfort.

In a refrigerating device, such as a refrigerator, for heating or cooling material goods, inoperativeness of the refrigerating device caused by a failure in a compressor leads to damage to material goods to be heated or cooled and causes a not-so-little economic loss. For this reason, in air conditioning for personnel and property, it is important to detect any failure and maintain a compressor before the compressor becomes inoperative for stable operation of the air conditioner or the refrigerating device.

One of means for achieving stable operation of an air conditioner or a refrigerating device is to detect any failure in a compressor at an early stage to avoid sudden inoperativeness for users.

In the configuration described in Patent Literature 1, any anomaly is detected at a compressor internal state estimating device by detecting an instantaneous current or instantaneous voltage applied to a compressor and estimating a motor driving torque using an arithmetic expression. However, this configuration described in Patent Literature 1 requires the compressor internal state estimating device and thus preparing a control board for the compressor internal state estimating device. Therefore, an outdoor unit of an air conditioner with a limited space in the machine poses a difficult problem in terms of price as well as structure.

With respect to instantaneous current and instantaneous voltage, it is difficult to detect a change caused by any anomaly in a compressor before the compressor failure becomes noticeable. For this reason, it is difficult to detect any anomaly in a compressor at an early stage in an air conditioner or a refrigerating device in which a refrigerating cycle is comprised of the compressor, a condenser, an expansion mechanism, and a vaporizer. (Hereafter, these will be collectively referred to as air conditioner.)

The present invention provides an air conditioner equipped with a means for predicting and detecting any failure in a compressor and a method for predicting and detecting the failure, making it possible to address the above-mentioned problem associated with the related art and detect any anomaly at an early stage.

Solution to Problem

To address the above-mentioned problem, the present invention provides an air conditioner equipped with a heat exchanger, a compressor, piping connecting the heat exchanger and the compressor, and a control unit controlling the compressor and having a means for predicting and detecting any failure in the compressor. In the control unit of the air conditioner, the means for predicting and detecting any failure in the compressor is composed of: a current detecting part detecting a driving current for driving the compressor; a pulsation detecting part detecting pulsation in the driving current detected by the current detecting part; and an anomaly determining part predicting or detecting any failure in the compressor based on a magnitude and a duration of the pulsation in the driving current detected by the pulsation detecting part.

To address the above-mentioned problem, the present invention provides a method for predicting and detecting any failure in a compressor of an air conditioner equipped with a heat exchanger, the compressor, piping connecting the heat exchanger and the compressor, and a control unit controlling the compressor. The method includes the steps of: detecting a driving current for driving the compressor by a current detecting part; detecting pulsation in the driving current detected by the current detecting part by a pulsation detecting part; and predicting or detecting any failure in the compressor by an anomaly determining part based on a magnitude and a duration of the pulsation in the driving current detected by the pulsation detecting part.

Advantageous Effects of Invention

With an air conditioner equipped with a means for predicting and detecting any failure in a compressor and a method for predicting and detecting the failure in accordance with the present invention, it is possible to detect any early-stage anomaly in the compressor, which is conventionally difficult to detect through an absolute value of current or voltage, to maintain the air conditioner and replace parts of the air conditioner as planned, and to enhance an air conditioner user's comfort and reliability from the user.

DESCRIPTION OF EMBODIMENTS

The present invention relates to an air conditioner provided with a function of predicting and detecting any failure in a compressor.

In all the drawings illustrating embodiments of the present invention, members having an identical function will be marked with an identical reference sign and a repetitive description thereof will be omitted in principle. Hereafter, a detailed description will be given to embodiments of the present invention with reference to the drawings.

However, the present invention should not be construed as being limited to the embodiments described below. Those skilled in art will easily understand that a concrete configuration of the embodiments can be modified without departing from the technical ideas or subject matter of the present invention.

Example

An example of the present invention in a refrigerating cycle of an air conditioner will be described as a representative example of the present invention. However, the same effect as in the present invention will be brought about in any refrigerating device including a refrigerating cycle composed of a compressor, a condenser, an expansion mechanism, and an evaporator.

Figure 1:
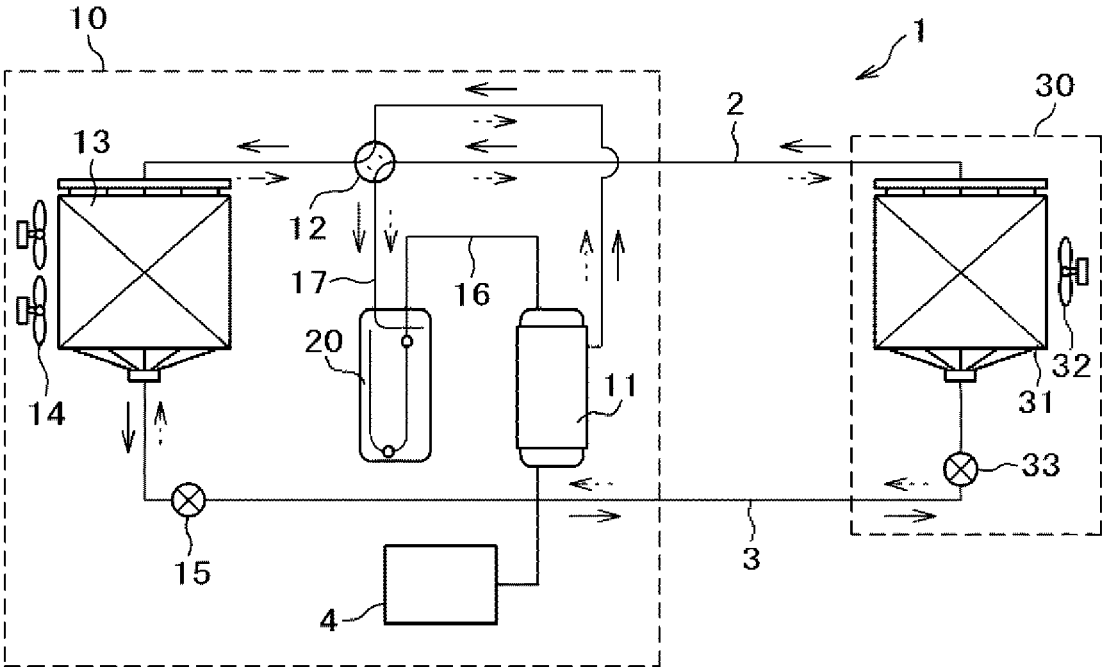
FIG. 1 is a block diagram illustrating a refrigerating cycle configuration of an air conditioner in an example of the present invention.

FIG. 1 illustrates a refrigerating cycle of a typical air conditioner 1. The air conditioner 1 includes an outdoor unit 10 and an indoor unit 30 and these units are in communication with each other through gas connection piping 2 and liquid connection piping 3.

The outdoor unit 10 includes a compressor 11, a four-way valve 12, an outdoor heat exchanger 13, an outdoor blower 14, an outdoor expansion valve 15, an accumulator 20, a compressor suction pipe 16, a gas refrigerant pipe 17, and a control unit 4.

The compressor 11 and the accumulator 20 are connected with each other through the compressor suction pipe 16 and the four-way valve 12 and the accumulator 20 are connected with each other through the refrigerant pipe 17.

The compressor 11 compresses and discharges a refrigerant into piping. A flow of a refrigerant is changed and an operation is switched between cooling and heating by changing the setting of the four-way valve 12. The outdoor heat exchanger 13 exchanges heat between a refrigerant and outside air. The outdoor blower 14 supplies outside air to the outdoor heat exchanger 13. The outdoor expansion valve 15 reduces the pressure of a refrigerant to lower the temperature of the refrigerant. The accumulator 20 is provided for retaining returned liquid during a period of transition and adjusts a refrigerant to an appropriate level of dryness.

The indoor unit 30 includes an indoor heat exchanger 31, an indoor blower 32, and an indoor expansion valve 33. The indoor heat exchanger 31 exchanges heat between a refrigerant and inside air. The indoor blower 32 supplies outside air to the indoor heat exchanger 31. The indoor expansion valve 33 can change a flow rate of a refrigerant flowing through the indoor heat exchanger 31 by varying an amount of throttling of the indoor expansion valve.

A description will be given to a cooling operation of the air conditioner 1. Solid-line arrows in FIG. 1 show a flow of a refrigerant during a cooling operation of the air conditioner 1. During a cooling operation, the four-way valve 12 brings the discharge side of the compressor 11 and the outdoor heat exchanger 13 into communication with each other and brings the accumulator 20 and the gas connection piping 2 into communication with each other as shown by the solid lines.

A high-temperature, high-pressure gas refrigerant compressed and discharged from the compressor 11 flows into the outdoor heat exchanger 13 by way of the four-way valve 12 and cooled and condensed by outside air sent by the outdoor blower 14. The condensed liquid refrigerant is sent to the indoor unit 30 by way of the outdoor expansion valve 15 and the liquid connection piping 3. The liquid refrigerant that flowed into the indoor unit 30 is reduced in pressure by the indoor expansion valve 33 and turned into a low-pressure, low-temperature gas-liquid two-phase refrigerant, which in turn flows into the indoor heat exchanger 31. At the indoor heat exchanger 31, the gas-liquid two-phase liquid refrigerant is heated and vaporized by indoor air sent by the indoor blower 32 and is turned into a gas refrigerant. At this time, inside air is cooled by the latent heat of vaporization of the refrigerant and cold air is sent into the room. Thereafter, the gas refrigerant is returned to the outdoor unit 10 by way of the gas connection piping 2.

The gas refrigerant that returned to the outdoor unit 10 flows into the accumulator 20 by way of the four-way valve 12 and the gas refrigerant pipe 17. The refrigerant is adjusted to a predetermined level of dryness at the accumulator 20 and sucked into the compressor 11 by way of the compressor suction pipe 16, and compressed at the compressor 11 again. This completes a single refrigerating cycle.

A description will be given to a heating operation of the air conditioner 1. Broken-line arrows in FIG. 1 show a flow of a refrigerant during a heating operation of the air conditioner 100. During a heating operation, the four-way valve 12 brings the discharge side of the compressor 11 and the gas connection piping 2 into communication with each other and brings the accumulator 20 and the outdoor heat exchanger 13 into communication with each other as shown by the broken lines.

A high-temperature, high-pressure gas refrigerant compressed and discharged from the compressor 11 is sent to the indoor unit 30 by way of the gas connection piping 2 and the four-way valve 12. The gas refrigerant that flowed into the indoor unit 30 flows into the indoor heat exchanger 31. The refrigerant is cooled and condensed by inside air sent by the indoor blower 32 and turned into a high-pressure liquid refrigerant. At this time, inside air is heated by the refrigerant and warm air is sent into the room. Thereafter, the liquefied refrigerant is returned to the outdoor unit 10 by way of the indoor expansion valve 33 and the liquid connection piping 3.

The liquid refrigerant that returned to the outdoor unit 10 is reduced in pressure by a predetermined amount at the outdoor expansion valve 15 and turned into a low-temperature gas-liquid two-phase state and flows into the outdoor heat exchanger 13. The refrigerant that flowed into the outdoor heat exchanger 13 has heat exchanged between the refrigerant and outside air sent by the outdoor blower 14 and is turned into a low-pressure gas refrigerant. The gas refrigerant flowing out from the outdoor heat exchanger 13 flows into the accumulator 20 by way of the four-way valve 12 and the gas refrigerant pipe 17. The refrigerant is adjusted to a predetermined level of dryness at the accumulator 20 and is sucked into the compressor 11 and compressed at the compressor 11 again. This completes a single refrigerating cycle.

Figure 2:
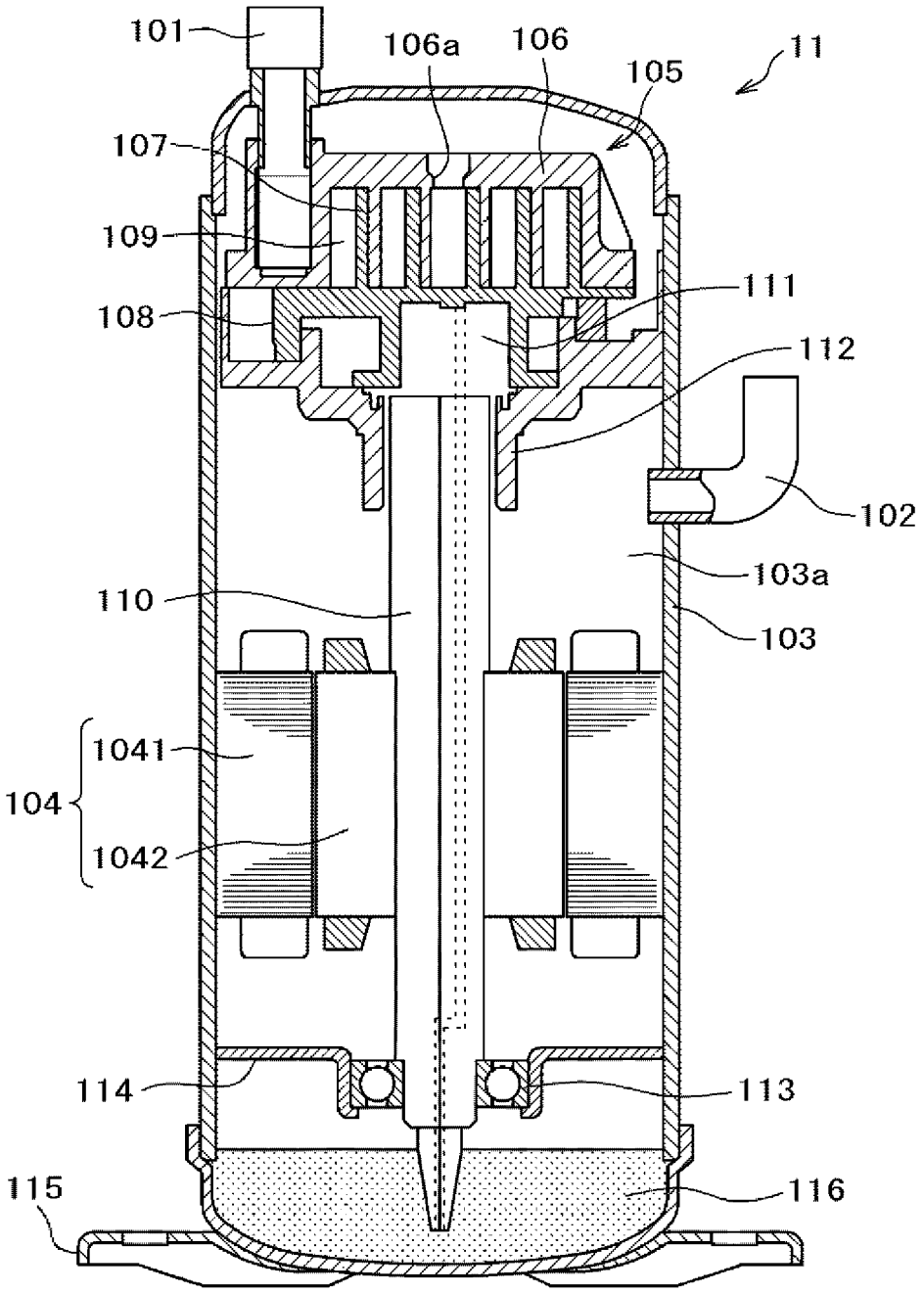
FIG. 2 is a sectional view illustrating an internal structure of a compressor used in an air conditioner in an example of the present invention.

FIG. 2 illustrates an internal structure of a high-pressure chamber type scroll compressor as a representative example of a compressor 11 used in the above-mentioned refrigerating cycle of the air conditioner. The scroll compressor 11 includes a pressure vessel 103 having a suction pipe 101 and a discharge pipe 102. A discharge pressure chamber 103*a* is formed inside the pressure vessel 103. The pressure vessel 103 accommodates a motor 104 having a stator 1041 and a rotor 1042 and a compression mechanical section 105 and refrigerator oil 116 is stored at the lower part of the pressure vessel. The pressure vessel 103 is supported on a pedestal 115.

The compression mechanical section 105 includes a fixed scroll 106 having a spiral gas passage and a turning scroll 108 having a spiral lap 107. The turning scroll 108 is disposed such that the turning scroll is movable relative to the fixed scroll 106 and a compression chamber 109 is formed by the fixed scroll 106 and the turning scroll 108 being engaged with each other. The turning scroll 108 is coupled with an Oldham ring (not shown) that arrests rotation of the turning scroll and yet allows revolution thereof and is coupled with an eccentric portion 111 of a crankshaft 110 rotationally driven by the motor 104. A discharge port 106*a* is formed in the fixed scroll 106.

By driving of the motor 104, the crankshaft 110 is rotated and the turning scroll 108 is turned and further a refrigerant sucked from the suction pipe 101 is guided into the compression chamber 109 and gradually compressed there. The compressed refrigerant is discharged from the discharge port 106*a* of the fixed scroll 106 into the discharge pressure chamber 103*a*.

The crankshaft 110 is supported by a bearing 112 and a bearing 113. The bearing 113 is supported in the pressure vessel 103 by a supporting member 114. A compression mechanism of a refrigerant compressor, that is, a compression chamber composed of a fixed scroll and a turning scroll in a scroll compressor is low in dimensional tolerance. If the bearings 112 and 113 are damaged by insufficient lubricating oil or the like, the crankshaft 110 would be made eccentric and the turning scroll 107 and the fixed scroll 106 be brought into contact with each other beyond a normal design value. As a result, galling or the like would occur and prevent a smooth compression stroke and at worst, seizure take place and compression become infeasible. Therefore, when the bearings 112 and 113 are damaged, a swinging load has been produced by eccentricity of the crankshaft.

At an early stage at which this swinging load is initiated, it is difficult to sense occurrence of an abnormal vibration or an unusual noise. Further, the absolute value of current itself does not vary so much and it is difficult to detect the variation at a control unit. However, this swinging load, that is, torque change causes pulsation in a current of the motor. Any anomaly inside the compressor can be detected at an early stage by measuring this current pulsation.

Hereafter, a description will be given to a means for predicting and detecting any failure in a compressor and a method for predicting and detecting any failure in a compressor which means and method make it possible to detect any anomaly inside the compressor by measuring the above-mentioned current pulsation.

As described with reference to FIG. 1, in the air conditioner 1, a refrigerating cycle is constituted by connecting the outdoor unit 10 and the indoor unit 30 through the refrigerant pipe 2 and the liquid connection piping 3 for conditioning air.

As illustrated in FIG. 2, the outdoor unit 10 of the air conditioner 1 includes: the compressor 11 compressing a refrigerant to a high temperature and a high pressure; the compressor motor 104 rotationally driving the compressor 11; and the control unit 4 (controlling means) that controls the entire outdoor unit 10 and the entire indoor unit 30 and controls driving of the compressor motor 104 to a desired rotational speed and further detects any anomaly in the compressor motor 104.

Figure 3:
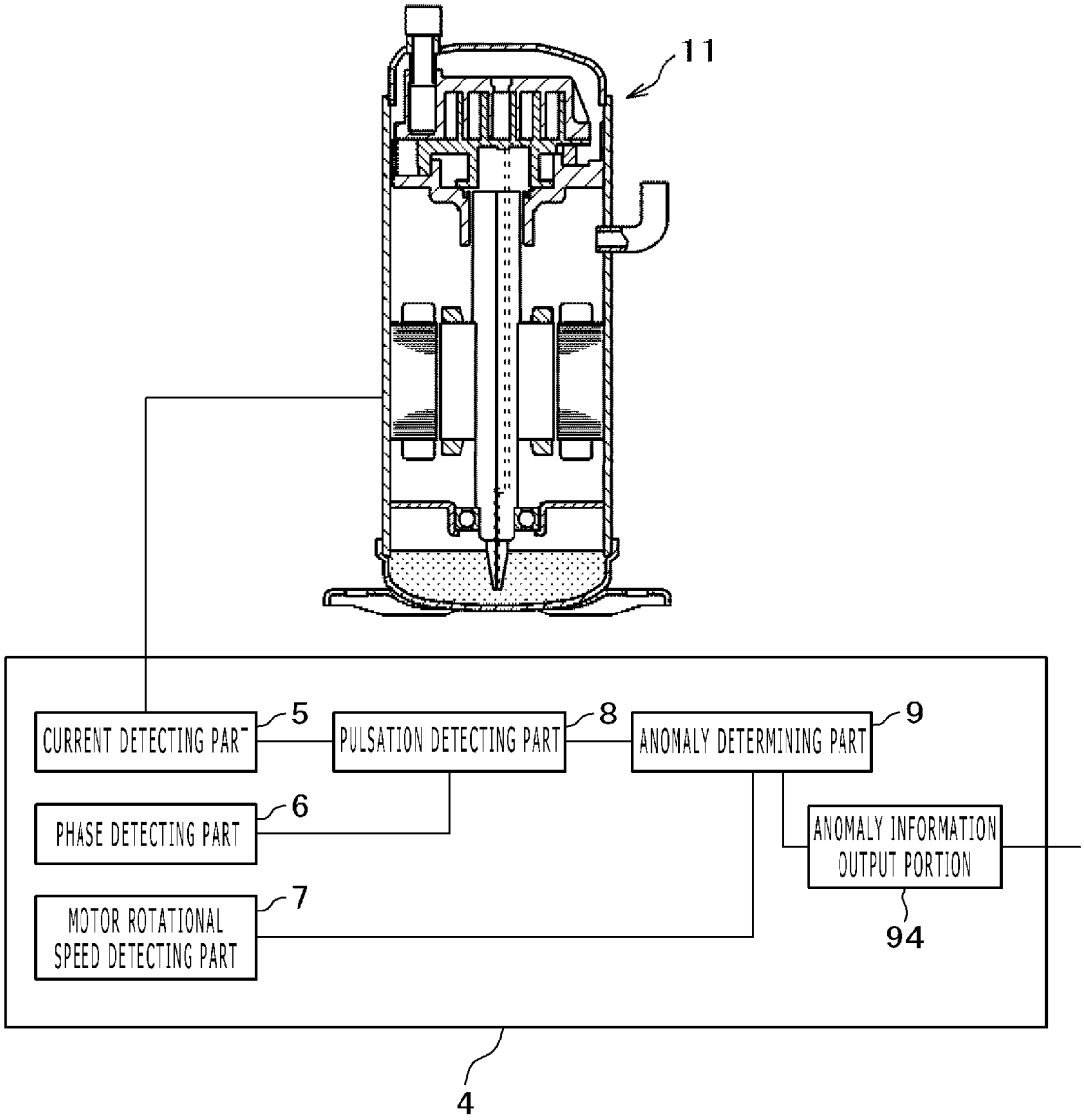
FIG. 3 is a block diagram schematically illustrating a compressor and a control unit used in an air conditioner in an example of the present invention.

As illustrated in FIG. 3, the control unit 4 includes as means for predicting and detecting any failure (anomaly) in the compressor motor 104: a current detecting part 5 (current detecting means) detecting an output current of the compressor motor 104; a phase detecting part 6 (phase detecting means) detecting a magnetic pole position of the compressor motor 104; a motor rotational speed detecting part 7 (rotational speed detecting means) detecting a rotational speed of the compressor motor 104; a pulsation detecting part 8 (pulsation detecting means) detecting pulsation in the detected current value of the compressor motor 104 based on the current value and magnetic pole position information; an anomaly determining part 9 determining any compressor anomaly based on the detected pulsation in current value and motor rotational speed; and an anomaly information output portion 91 outputting information on an anomaly determined by the anomaly determining part 9. The control unit 4 also includes: a circuit (not shown) controlling the entire outdoor unit 10 and the entire indoor unit 30; and a circuit (not shown) controlling driving of the compressor motor 104.

Figure 4A:
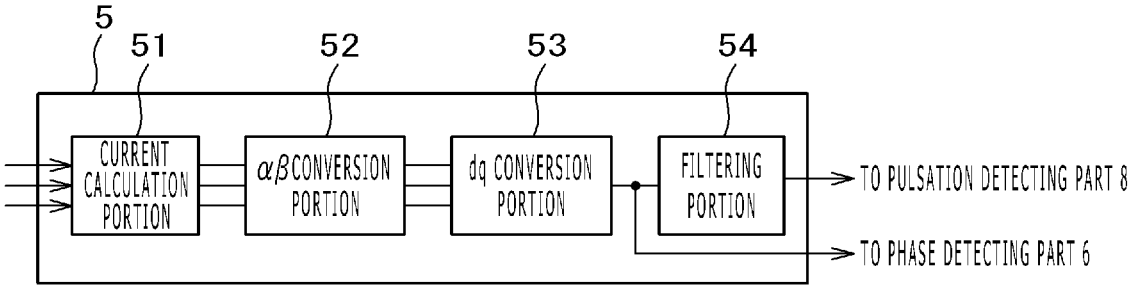
FIG. 4A is a block diagram illustrating a configuration of a current detecting part of a control unit used in an air conditioner in an example of the present invention.

As shown in FIG. 4A, the current detecting part 5 includes: a current calculation portion 51 determining a motor current flowing through the compressor motor 104; an αβ conversion portion 52 αβ-converting the determined motor current; a dq conversion portion 53 dq-converting the αβ-converted data; and a filtering portion 54 filtering the dq-converted result to calculate a q-axis current feedback value. A q-axis current feedback value calculated at the filtering portion 54 is outputted to the pulsation detecting part 8.

Figure 4B:
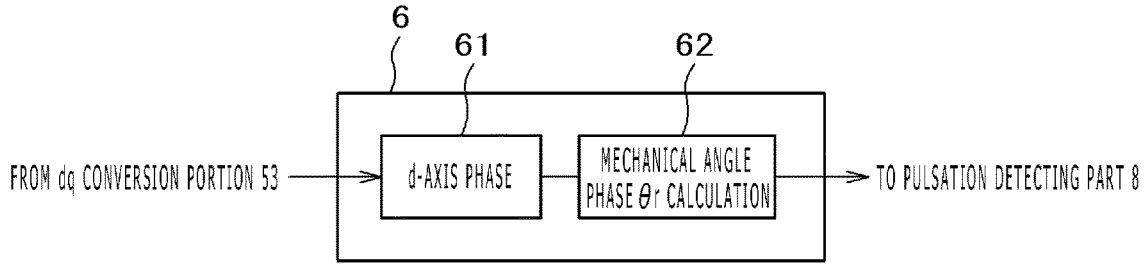
FIG. 4B is a block diagram illustrating a configuration of a phase detecting part of a control unit used in an air conditioner in an example of the present invention.

As illustrated in FIG. 4B, the phase detecting part 6 includes: a d-axis phase extraction portion 61 that is fed with information dq-converted at the dq conversion portion 53 of the current detecting part 5 and extracts θdc as d-axis phase information; and a mechanical angle phase calculation portion that calculates a mechanical angle phase θr using the θdc information extracted at the d-axis phase extraction portion 61. The calculated mechanical angle phase information is outputted to the pulsation detecting part 8.

The pulsation detecting part 8 detects pulsation in a current value of the compressor motor 104 (hereafter, referred to as motor current value) from detection results from the current detecting part 5 and the phase detecting part 6.

Figure 4C:
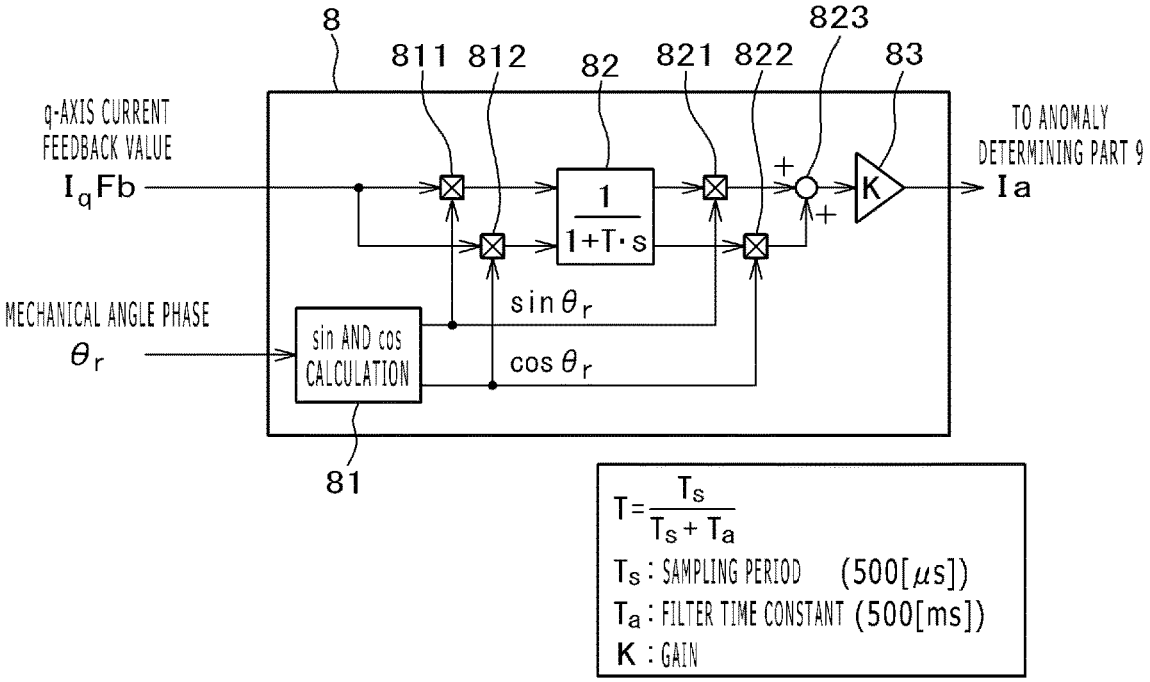
FIG. 4C is a block diagram illustrating a pulsation detecting part of a control unit used in an air conditioner in an example of the present invention.

FIG. 4C illustrates an exemplary configuration of the pulsation detecting part 8.

First, the current detecting part 5 detects a three-phase output current (Iu, Iv, Iw) from the compressor motor 104 at the current calculation portion 51 with the configuration illustrated in FIG. 4A. Specifically, a current flowing through a direct-current portion of an inverter (not shown) driving the compressor motor 104 is measured from a voltage produced across a shunt resistor (not shown). Then, a motor current (Iu, Iv, Iw) is derived by the current calculation portion 51. There are various methods for detecting a motor current (Iu, Iv, Iw) including a method in which a resistor low in resistance value is connected to a motor current output part and a motor current is detected from a voltage applied to the resistor and detection with a current sensor.

The detected motor current (Iu, Iv, Iw) is αβ-converted and dq-converted in this order at the αβ conversion portion 52 and the dq conversion portion 53 in accordance with (Expression 1) below and an obtained result is filtered with a first-order lag at the filtering portion 54. Thus, a q-axis current feedback value to be an input value to the pulsation detecting part 8 is calculated.

[Expression 1]

$$\begin{bmatrix} i_\alpha \\ i_\beta \end{bmatrix} = \frac{2}{3}\begin{bmatrix} 1 & -\cos 60^\circ & -\cos 60^\circ \\ 0 & +\cos 30^\circ & -\cos 30^\circ \end{bmatrix} \cdot \begin{bmatrix} i_u \\ i_v \\ i_w \end{bmatrix} = \frac{2}{3}\begin{bmatrix} 1 & -\frac{1}{2} & -\frac{1}{2} \\ 0 & +\frac{\sqrt{3}}{2} & -\frac{\sqrt{3}}{2} \end{bmatrix} \cdot \begin{bmatrix} i_u \\ i_v \\ i_w \end{bmatrix} \quad \text{(Expression 1)}$$

$$\begin{bmatrix} i_d \\ i_q \end{bmatrix} = \begin{bmatrix} \cos\theta_{dc} & \sin\theta_{dc} \\ -\sin\theta_{dc} & \cos\theta_{dc} \end{bmatrix} \cdot \begin{bmatrix} i_\alpha \\ i_\beta \end{bmatrix}$$

In (Expression 1), θdc used in dq conversion at the dq conversion portion 53 is in a d-axis phase and indicates a magnetic pole position of the compressor motor 104.

A mechanical angle phase θr as a second input value to the pulsation detecting part 8 is calculated from θdc. This calculation is represented by (Expression 2) below:

$$\Delta\theta r = \Delta\theta dc / \text{number of pole pairs} \quad \text{(Expression 2)}$$

θr is calculated by integrating Δθr. A pulsation component is extracted from the above-mentioned two inputs, the q-axis current feedback value and the mechanical angle phase θr.

As illustrated in FIG. 4A, sin θr and cos θr are calculated from the mechanical angle phase θr inputted from the phase detecting part 5 through sin and cos calculations at a calculation portion 81. Calculation results are respectively multiplied by a q-axis current feedback value inputted from the current detecting part 5 at multipliers 811 and 812 and filtered with a first-order lag at a filtering portion 82 to remove a high frequency component.

A filtering time constant T for the first-order lag filtering at the filtering portion 82 is set by simulation based on testing on an actual machine such that a torque pulsation period can be extracted. A more specific description will be given. To extract a pulsation component, a time constant T for filtering must be made larger than a pulsation period; therefore, a time constant is set to a value larger than a rotation period of the compressor 11 at which torque pulsation occurs.

After first-order lag filtering at the filtering portion 82, results of the filtering are multiplied by sin θr and cos θr at multipliers 821 and 822 again and results of the multiplication are added together at an adder 823. Then, a pulsation component is adjusted at a gain adjuster 83. This makes it possible to extract only a component that pulsates with a period of the mechanical angle phase θr. FIG. 4C shows 500 μs of Ts and 500 ms of Ta as examples of the set values of sampling period Ts and filter time constant Ta.

Figure 5:
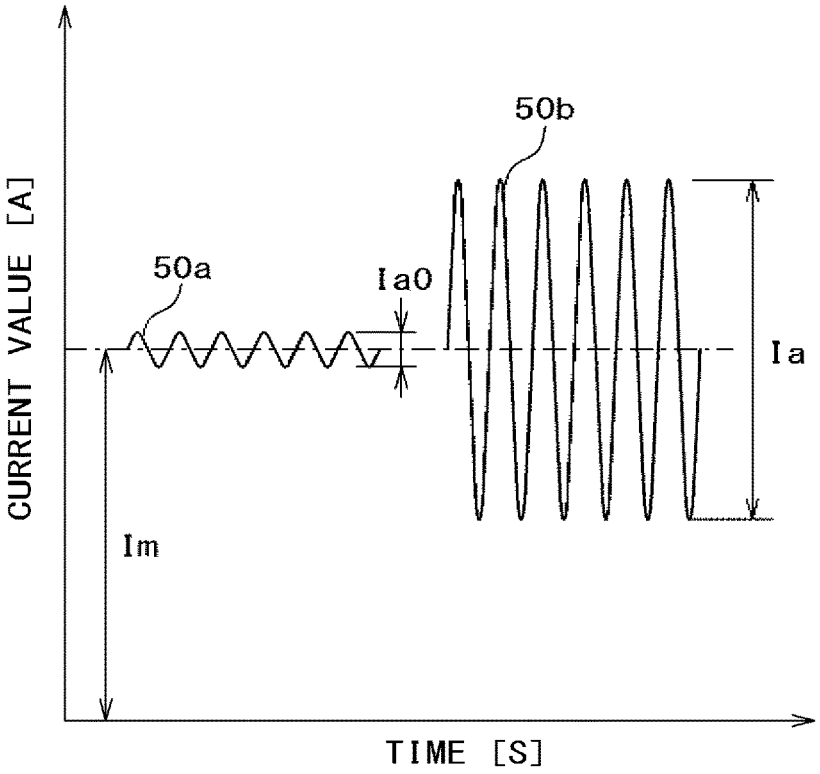
FIG. 5 is a current waveform chart showing pulsation in a current detected by a current detecting part of a control unit used in an air conditioner in an example of the present invention.

FIG. 5 is a waveform chart indicating pulsation in a current detected at the current detecting part 5 when an anomaly occurs in the compressor 11 of the air conditioner 1 and a swinging load is produced. Such anomalies that a swinging load is produced in the compressor 11 include damage to the bearing 112 or 113 supporting the rotation mechanism of the compressor 11, liquid compression in the compression chamber 109, poor lubrication at a contact area in the compression mechanical section, and the like. In FIG. 5, the curve 50*a* represents a current value waveform in a normal state detected at the current detecting part 5 and the curve 50*b* represents a current value waveform at the time of a compressor anomaly.

The current detecting part 5 illustrated in FIG. 3 detects a current of the compressor motor 104 with a certain sampling period.

When such an anomaly as mentioned above is present in the compressor 11 of the air conditioner 1, torque fluctuation in the compressor motor 104 becomes more violent that at normal times and this also takes place in an applied current of the compressor motor 104. For this reason, as indicated by the curve 50*b* in FIG. 5, a pulsation value (or amplitude) Ia relative to an average current value Im is increased as compared with a pulsation value $Ia_o$ at normal times. Since the applied current is also increased with increase in rotational speed of the compressor motor 104, the average current value Im is also increased. Therefore, any anomaly in the compressor 11 can be detected with accuracy with a current pulsation value Ia rather than an average current value.

A description will be given to an operation of the air conditioner 1 performed when a compressor anomaly is detected from a current pulsation value.

Figure 6:
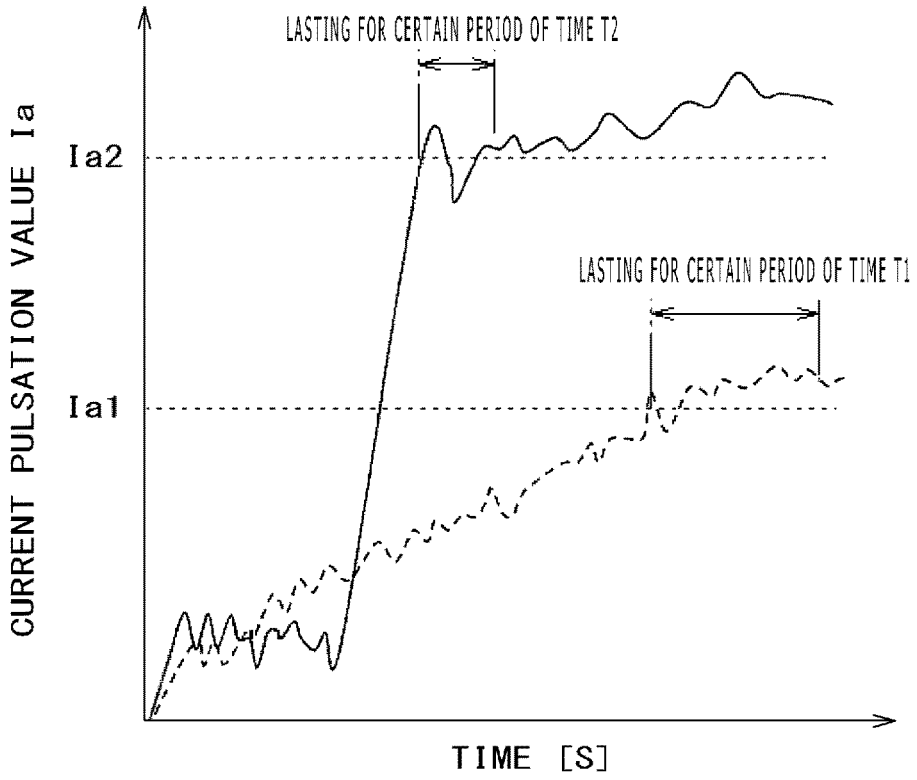
FIG. 6 is a current pulsation value waveform chart showing pulsation in a current detected by a pulsation detecting part of a control unit used in an air conditioner in an example of the present invention.

FIG. 6 indicates threshold values Ia1, Ia2 used for detecting a compressor anomaly from a current pulsation value.

It is desirable that the threshold values Ia1, Ia2 are set beforehand the operation, based on the testing of a normal compressor and a compressor inside which an anomaly is observed or the like. When as a result of determination at the anomaly determining part 9, a current pulsation value Ia exceeds the threshold value Ia1 for a certain period of time (T1) as indicated by the broken line in the graph, an air conditioner user is notified of an anomaly from the anomaly information output portion 91. Or, maintenance personnel for the air conditioner are notified of the anomaly in the air conditioner by remote monitoring or a smartphone through the Internet or the like. Thus, the air conditioner can be maintained at an early stage.

When the current pulsation value exceeds the threshold Ia1 for a certain period of time (T1), the anomaly is at an initial stage; therefore, an operation can be continued during a predetermined period of time only by notifying a compressor anomaly to the user. However, in case of an air conditioner high in refrigerating capacity provided with a plurality of compressors, it is desirable to stop an operation of a compressor in which an anomaly is detected by the air conditioner control unit and causes any other compressor to be operated to ensure a refrigerating capacity. Ia1 is effective in detecting any event, such as damage to a bearing, in which an anomaly gradually progresses in proportion to an operating time of the compressor.

When the current pulsation Ia is abruptly increased and exceeds the threshold value Ia2 before exceeding Ia1 for a certain period of time (T2) as indicated by the solid line in the graph in FIG. 6, that is equivalent a state in which an anomaly, such as damage to the bearing 112 or 113, has developed in the compressor 11. Since the anomaly determining part 9 determines that an anomaly has occurred in the compressor 11, it is desirable to stop the compressor 11 based on an alarm from the anomaly information output portion 91.

Figure 4D:
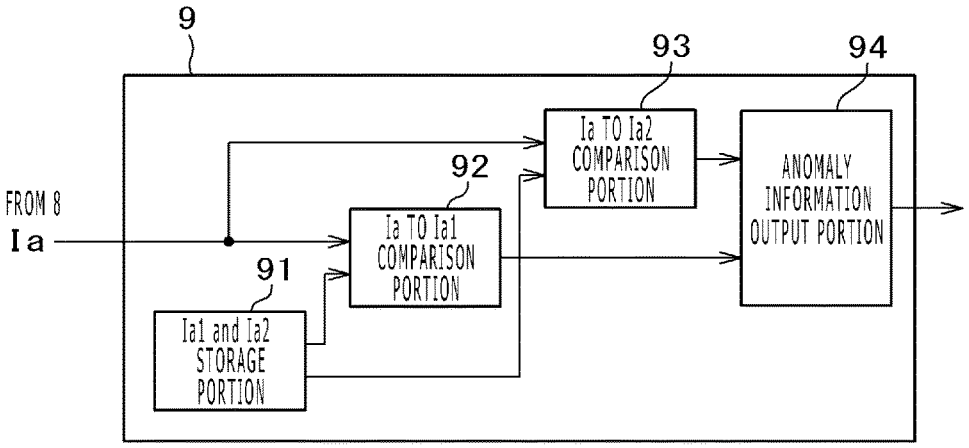
FIG. 4D is a block diagram illustrating a configuration of an anomaly determining part of a control unit used in an air conditioner in an example of the present invention.

FIG. 4D illustrates a configuration of the above-mentioned anomaly determining part 9 determining any anomaly in the compressor 11. The anomaly determining part 9 includes: a storage portion 91 storing threshold values Ia1, Ia2 beforehand the operation; a first comparison portion 92 comparing information on a current pulsation value Ia outputted from the pulsation detecting part 8 with Ia1 stored in the storage portion; a second comparison portion 93 comparing information on a current pulsation value Ia outputted from the pulsation detecting part 8 with Ia2 stored in the storage portion 91; and the anomaly information output portion 94 that, in response to information on results of comparisons at the first comparison portion 92 and the second comparison portion 93, outputs anomaly information.

Figure 7:
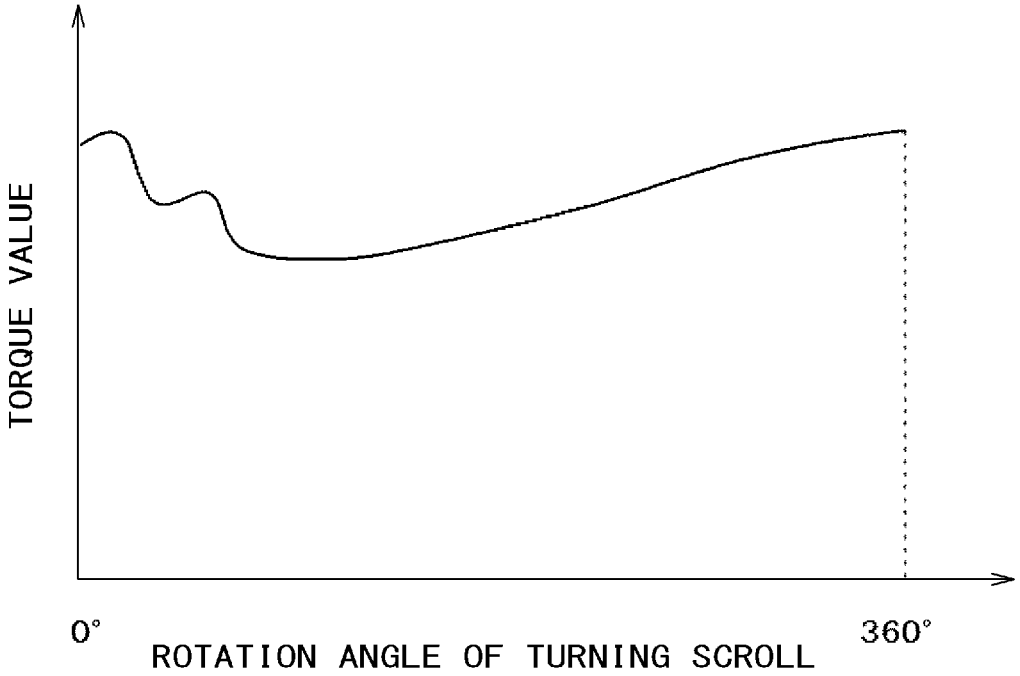
FIG. 7 is a graph showing variation in torque in one turn of a turning scroll observed when a scroll compressor is used in an air conditioner in an example of the present invention.

FIG. 7 is a graph indicating change in torque observed while a turning scroll is rotated by one turn in a scroll compressor. During a refrigerant compression stroke at a scroll compressor, as mentioned above, a refrigerant sucked into a compression chamber is compressed as a volume of the compression chamber is gradually reduced with rotation of the turning scroll. During this stroke, torque is changed due to a refrigerant gas load while the turning scroll is rotated by one turn.

In a scroll compressor, as indicated in FIG. 7, a torque is changed by one cycle while a turning scroll is rotated by one turn, that is, a compressor motor is rotated by one turn. Therefore, even in a normal compressor, pulsation occurs in the number of rotations first-order component of the compressor motor.

Even in a normal compressor, this occurs with refrigerant compression. Therefore, an anomaly in a compressor can be detected with higher accuracy by taking into account current pulsation associated with the above-mentioned refrigerant compression and the like when setting threshold values Ia1 and Ia2 for a current pulsation value Ia, described with reference to FIG. 6.

Rotary compressors are also frequently used as a compressor of an air conditioner 1. Like a scroll type, rotary compressors are also provided with a displacement type compression mechanism, in which the volume of a compression chamber is varied by a rotating rolling piston and as a result, a refrigerant is compressed. There are various types of rotary compressors, including one-cylinder type provided with a single compression chamber and two-cylinder type provided with two compression chambers. In case where two compression chambers are provided, compression strokes are shifted by 180 degrees in one rotation of a compressor motor.

Figure 8:
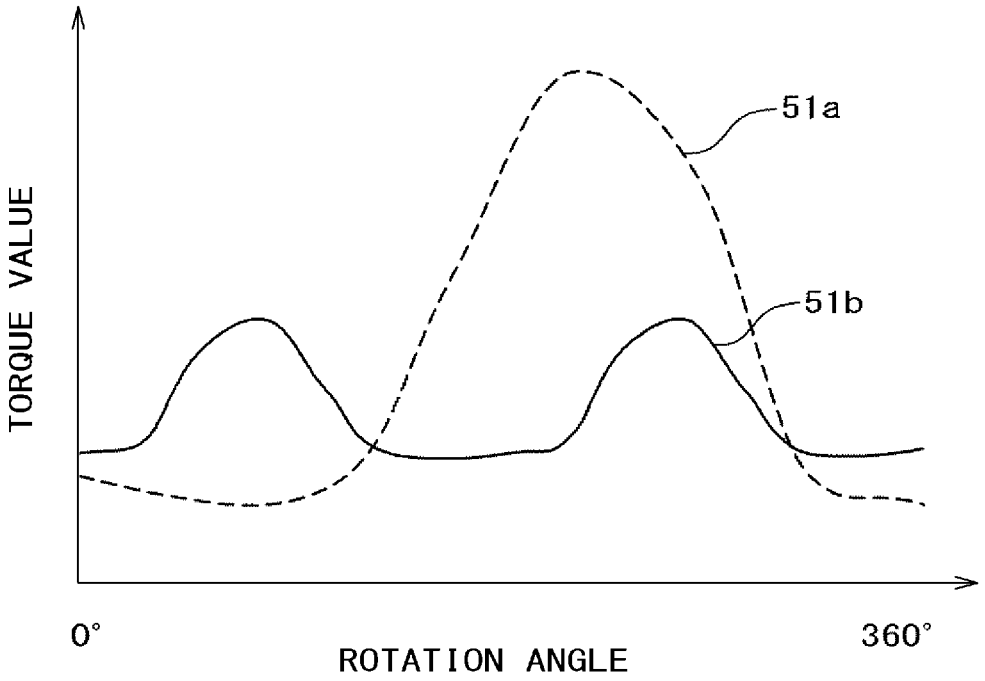
FIG. 8 is a graph showing variation in torque in one rotation of a motor observed when a rotary compressor is used in an air conditioner in an example of the present invention.

FIG. 8 schematically indicates change in torque that takes place while a compressor motor is rotated by one turn in a rotary compressor. The curve 51*a* represents torque change in one-cylinder type and the curve 51*b* represents torque change in two-cylinder type. Since in two-cylinder type, compression strokes are shifted by 180 degrees, torque change equivalent to two cycles takes place in one rotation of a compressor motor as indicated by the curve 51*b*. Therefore, even in a normal compressor, current pulsation is observed in a second-order component of a number of rotations of the compressor motor. Therefore, components of a current pulsation value present in a normal compressor differ depending on the structure of the compressor. For this reason, any anomaly in a compressor of an air conditioner can be detected with higher accuracy by taking the foregoing into account when setting threshold values Ia1, Ia2 for a current pulsation value.

Figure 9:
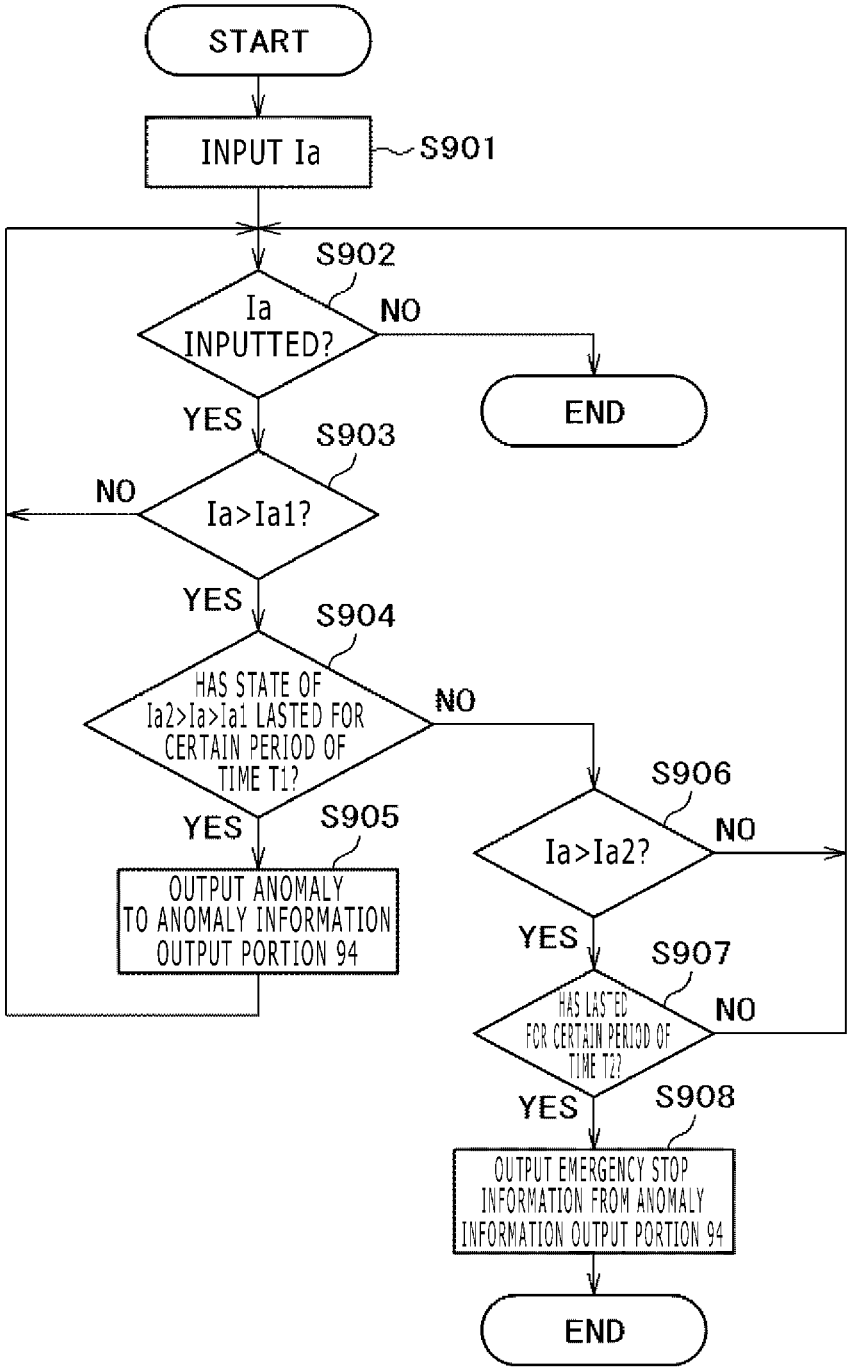
FIG. 9 is a flowchart illustrating a flow of anomaly determination processing at an anomaly determining part of a control unit used in an air conditioner in an example of the present invention.

A description will be given to a processing flow of anomaly determination at the anomaly determining part 9 with reference to FIG. 9.

After start of an operation of the compressor 11, a current pulsation value Ia outputted from the pulsation detecting part 8 that has received outputs from the current detecting part 5 and the phase detecting part 6 is inputted (S901). Subsequently, it is confirmed whether this current pulsation value Ia has been inputted (S902). When a current pulsation value Ia has not been inputted (NO at S902), the processing is terminated. When a current pulsation value Ia has been inputted (YES at S902), the inputted current pulsation value Ia is compared with a threshold value Ia1 stored in the storage portion 91 beforehand the operation (S902).

When the result of comparison at S902 reveals that the inputted current pulsation value Ia is smaller than the threshold value Ia1 (NO at S903), the processing returns to S902 and it is confirmed whether a current pulsation value Ia has been inputted from the pulsation detecting part 8. When the result of comparison at S902 reveals that the inputted current pulsation value Ia is larger than the threshold value Ia1 (YES at S903), it is confirmed whether a state in which the inputted current pulsation value Ia is larger than the threshold value Ia1 and smaller than a threshold value Ia2 has continued (lasted) for a preset certain period of time (T1) (S904).

When it is determined at S904 that a state in which the current pulsation value Ia is larger than the threshold value Ia1 and smaller than the threshold value Ia2 has continued (lasted) for the preset certain period of time (T1) (YES at S904), anomaly information is outputted to the anomaly output part 94 (S905). The processing then returns to S902 and it is confirmed whether a current pulsation value Ia has been inputted from the pulsation detecting part 8.

When it is determined at S904 that a state in which the current pulsation value Ia is larger than the threshold value Ia1 and smaller than the threshold value Ia2 has not yet continued for the preset certain period of time (T1) (NO at S904), the current pulsation value Ia is compared with the threshold value Ia2 stored in the storage portion 91 beforehand the operation (S906). When the result of comparison at S906 reveals that the current pulsation value Ia is smaller than the threshold value Ia2, the processing returns to S902 and it is confirmed whether a current pulsation value Ia has been inputted from the pulsation detecting part 8.

When the result of comparison at S906 reveals that the current pulsation value Ia is larger than the threshold value Ia2 (YES at S906), it is confirmed whether this state in which the inputted current pulsation value Ia is larger than the threshold value Ia2 has continued (lasted) for a preset certain period of time (T2) (S907). When the state in which the current pulsation value Ia is larger than the threshold value Ia2 has not continued for the preset certain period of time (T2) (NO at S907), the processing returns to S902 and it is confirmed whether a current pulsation value Ia has been inputted from the pulsation detecting part 8.

When the state in which the current pulsation value Ia is larger than the threshold value Ia2 has continued for the preset certain period of time (T2) or longer (YES at S907), emergency stop information is outputted from the anomaly information output portion 94 for stopping the compressor 11 (S908).

A description will be given to a flow of processing at the control unit 4 in this embodiment with reference to FIG. 10.

After start of an operation of the compressor 11, a motor current is detected at the current calculation portion 51 of the current detecting part 5 (S1001) and $\alpha\beta$ conversion is performed at the $\alpha\beta$ conversion portion 52 using a result of the detection (S1002). On a result of the conversion, dq conversion is performed at the dq conversion portion 53 (S1003) and a result of the dq conversion is filtered at the filtering portion 54 to calculate a q-axis current feedback value IqFb (S1004). The result of dq conversion by the dq conversion portion 53 at S1003 is also inputted to the phase detecting part 6. $\theta dc$ is extracted at the d-axis phase extraction portion 61 and a mechanical angle phase $\theta r$ is calculated at the mechanical angle phase calculation portion 62 (S1005).

Subsequently, information on the q-axis current feedback value IqFb obtained at the current detecting part 5 and the mechanical angle phase $\theta r$ obtained at the phase detecting part 6 is inputted to the pulsation detecting part 8 and is processed at the calculation portion 81, the filtering portion 82, and the adder 823 to extract a pulsation component Ia (S1006).

Information on the pulsation component Ia extracted at the pulsation detecting part 8 is inputted to the anomaly determining part 9 and any anomaly is predicted and detected in accordance with the processing flow described with reference to FIG. 9.

Figure 10:
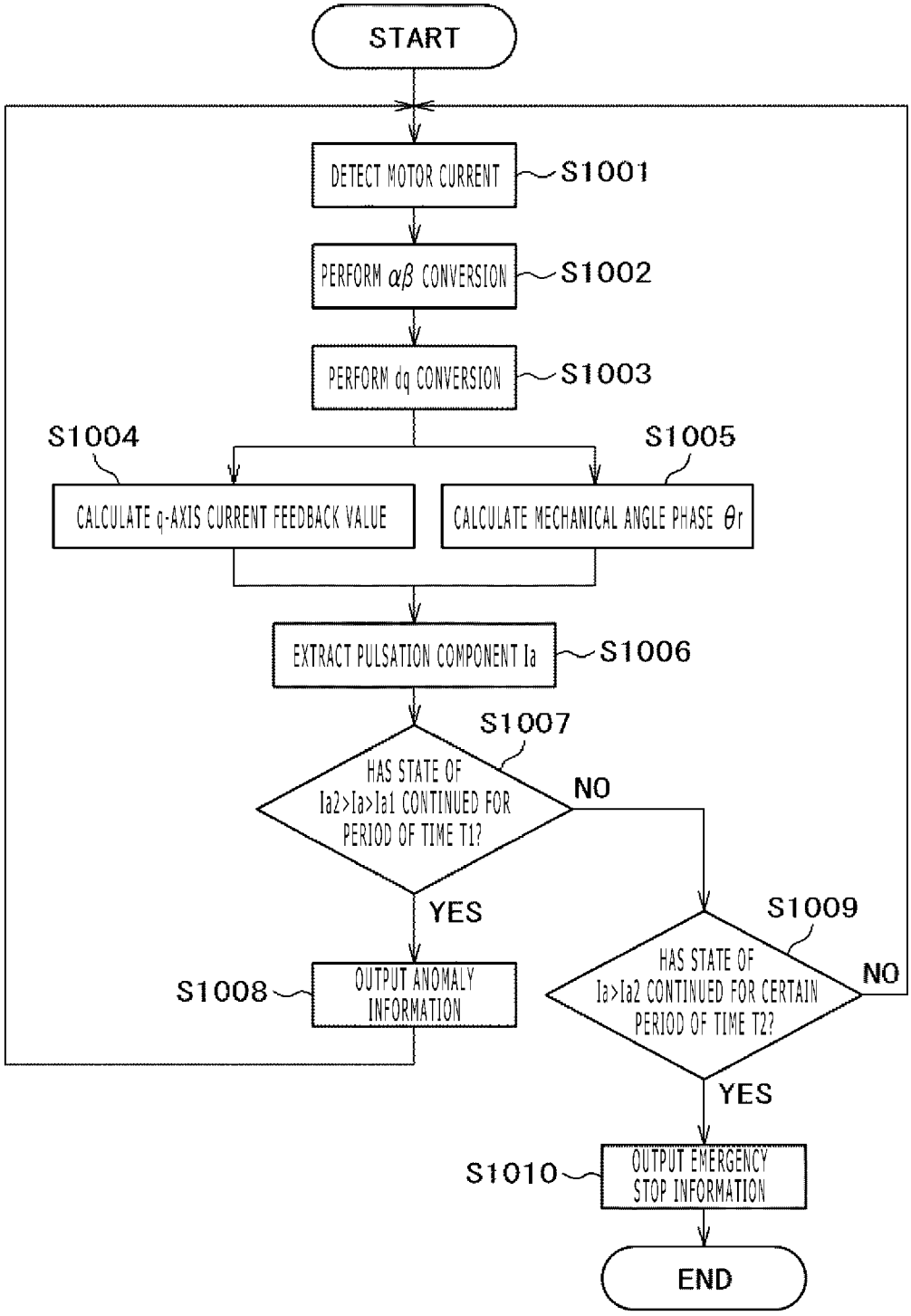
FIG. 10 is a flowchart illustrating a flow of anomaly determination processing at a control unit used in an air conditioner in an example of the present invention.

That is, as shown in FIG. 10, it is confirmed whether a state in which the pulsation component Ia is larger than a preset threshold value Ia1 and smaller than a preset threshold value Ia2 has continued (lasted) for a preset certain period of time (T1) (S1007). When a result of the confirmation reveals that the state has continued (lasted) for the certain period of time (T1) (YES at S1007), information indicating that the state in which the pulsation component Ia is larger than the preset threshold value Ia1 and smaller than the preset threshold value Ia2 has continued (lasted) for the preset certain period of time (T1) is outputted from the anomaly information output portion 94 (S1008). The processing then returns to S1001 and is continued.

When a result of the confirmation at S1007 reveals that a state in which the pulsation component Ia is larger than the preset threshold value Ia1 and smaller than the preset Ia2 has not continued (lasted) for the preset certain period of time (T1) (NO at S1007), it is confirmed whether a state in which the pulsation component Ia is larger than the preset threshold value Ia2 has continued (lasted) for a preset certain period of time (T2). When a negative determination is made, the processing returns to S1001 and is continued. When an affirmative determination is made at S1009, emergency stop information is outputted from the anomaly information output portion 94 (S1010) and the operation of the compressor 11 is stopped by the control unit 4. The step S903 in the flowchart described with reference to FIG. 9 is omitted from the flowchart described with reference to FIG. 10. The step S903 is substantially identical with a loop in which the processing proceeds from S1007 and is returned to S1001 by way of S1009; therefore, a description of the step is omitted.

According to the present invention, as described up to this point, any failure in a compressor provided in an air conditioner can be predicted and can be detected at an early stage. As a result, the air conditioner can be used with stability without stopping an operation for reason of any failure in the compressor.

REFERENCE SIGNS LIST

1: air conditioner,
4: control unit,
5: current detecting part,
6: phase detecting part,
7: motor rotational speed detecting part,
8: pulsation detecting part,
9: anomaly determining part,
10: outdoor unit,
11: refrigerant compressor,
30: indoor unit,
104: motor,
106: fixed scroll,
108: turning scroll,
112, 113: bearing.

The invention claimed is:

1. An air conditioner, comprising:
a heat exchanger;
a compressor driven by a motor;
piping connecting the heat exchanger and the compressor; and
a controller connected to the compressor, the controller configured to:
detect a driving current for driving the motor of the compressor;
obtain a mechanical angle phase of the motor from the detected driving current;
detect a pulsation in the detected driving current based on a q-axis current feedback value of the detected driving current and the obtained mechanical angle phase; and
predict or detect a compressor failure based on a magnitude and a duration of the detected pulsation in the detected driving current.

2. The air conditioner according to claim 1,
wherein the controller is further configured to predict the compressor failure based on a magnitude of the pulsation in the detected driving current exceeding a first threshold value for a first predetermined period of time and detect the compressor failure based on a magnitude of the pulsation in the detected driving current exceeding a second threshold value, which is different than the first threshold, for a second predetermined period of time, which is different than the first predetermined period of time.

3. The air conditioner according to claim 2, wherein the second threshold value is greater than the first threshold value, and wherein the second predetermined period of time is less than the first predetermined period of time.

4. A method for predicting and detecting a failure in a compressor in an air conditioner including a heat exchanger, the compressor having a motor, piping connecting the heat exchanger and the compressor, and a controller connected to the compressor, the method comprising the steps of:

detecting a driving current for driving the motor of the compressor;

obtain a mechanical angle phase of the motor from the detected driving current; and detecting a pulsation in the detected driving current based on a q-axis current feedback value of the detected driving current and the obtained mechanical angle phase; and predicting or detecting a failure in the compressor based on a magnitude and a duration of the detected pulsation in the detected driving current.

5. The method for predicting and detecting a failure in the compressor according to claim 4, wherein a failure in the compressor is predicted based on a magnitude of the pulsation in the detected driving current exceeding a first threshold value for a first predetermined period of time and a failure in the compressor is detected based on a magnitude of the pulsation in the detected driving current exceeding a second threshold value, which is different than the first threshold, for a second predetermined period of time, which is different than the first predetermined period of time.

6. The method for predicting and detecting a failure in the compressor according to claim 5, wherein the second threshold value is greater than the first threshold value, and wherein the second predetermined period of time is less than the first predetermined period of time.

* * * * *